US005387263A

United States Patent [19]

Marlowe et al.

[11] Patent Number: 5,387,263

[45] Date of Patent: Feb. 7, 1995

[54] METHOD FOR TREATMENT OF YARN IN PACKAGE FORM

[75] Inventors: Jack W. Marlowe, Reidsville; Ralph B. Monk, Roxboro; Rene A. Eckert, Greenboro, all of N.C.

[73] Assignee: Uhifi, Reidsville, N.C.

[21] Appl. No.: 168,671

[22] Filed: Dec. 16, 1993

[51] Int. Cl.[6] ..... D06P 5/02

[52] U.S. Cl. ..... 8/494; 8/580; 8/933; 252/8.8; 28/169

[58] Field of Search ..... 8/495, 494, 580, 115.6, 8/933; 28/169; 252/8.8

[56] References Cited

U.S. PATENT DOCUMENTS

| | | | |
|---|---|---|---|
| 1,677,852 | 7/1928 | Schaffer . | |
| 1,715,649 | 6/1929 | Filsinger . | |
| 1,720,595 | 7/1929 | Grier . | |
| 1,979,188 | 10/1934 | Bouhuys | 8/5 |
| 3,773,463 | 11/1934 | Cohen et al. | 8/17 |
| 3,821,136 | 6/1974 | Hudgin et al. | 260/9 |
| 3,984,595 | 10/1976 | Sano et al. | 28/72.6 |
| 4,097,232 | 6/1978 | Negola et al. | 8/65 |
| 4,583,987 | 4/1986 | Kurz | 8/495 |
| 5,165,993 | 11/1992 | van Anholt et al. | 428/364 |

*Primary Examiner*—Paul Lieberman
*Assistant Examiner*—Caroline L. Dusheck
*Attorney, Agent, or Firm*—Rhodes Coats & Bennett

[57] ABSTRACT

A process for applying a lubricant to a plurality of yarn packages directly to a dye bath in a package dyeing machine during the dyeing process. The process includes placing a plurality of yarn packages into a package dyeing machine. The plurality of yarn packages are then dyed in the package dyeing machine and the dye bath is cooled. A lubricant is then directly applied to the dye bath and the plurality of yarn packages in the package dyeing machine. In the preferred embodiment, the lubricant is a wax emulsion based on paraffin wax with a melting point of between about 138° F. to 143° F.

6 Claims, No Drawings

METHOD FOR TREATMENT OF YARN IN PACKAGE FORM

BACKGROUND OF THE INVENTION (1) Field of the Invention

The present invention relates generally to dyeing of textiles and, more particularly, to a method of applying a lubricant to a plurality of yarn packages directly in a package dyeing machine during the dyeing process.

(2) Description of the Prior Art

Presently, yarn is wrapped on dye springs or dye tubes, put into vats, dyed, dried and rewound onto paper tubes for shipment. During the rewinding process treatment aid,s such as lubricants, are added as the yarn is rewound. There are significant costs to rewind the yarn onto the paper tubes and apply the treating agents. These costs include the machinery, time, labor and the cost of the tube or spring itself. These costs can approach twenty-cents per pound of yarn which significantly adds to the cost of the final product.

U.S. Pat. No. 4,097,232, issued to Negola et al., discloses a method and apparatus for treating yarn in package form with a yarn treating agent to modify the physical and/or chemical characteristics of the yarn. The invention includes the steps of introducing the agent at selected portions of the outer surface of the package and then infusing the agent into the package with a heated fluid applied under pressure. For example, a dye acceptance modifier such as a resist or the dyestuff itself may be introduced to the ends of the package and a heated fluid, such as steam, for a time sufficient to cause the resist and dyes to penetrate the package and contact individual strands of yarn or fibers and to set the resist or dyes as needed. However, the method and apparatus as taught by Negola et al. envisions treating individual packages of yarn rather than in the vat itself and requires a heated fluid to carry the agent into the package.

In addition to the costs of applying lubricants and other treating agents while re-running the yarn, there also has been an increasing sensitivity to the volatility of chemicals added during the treatment of the yarn. Specifically, yarns and knitted and woven fabrics are now required by most U.S. and foreign automobile manufacturers to pass "fogging" tests which measure the susceptibility of the fabric to produce volatile chemicals which may condense onto the interior surfaces and glass of new automobiles. Accordingly, lubricants which are added to yarns now must both give excellent frictional values and lubricity numbers to the yarn but, as importantly, allow the yarn to pass the manufacturer's fogging test.

Thus, there remains a need for a new method of lubricating the yarn directly in the package dyeing machine during the dyeing process while, at the same time, imparting excellent frictional values, thereby allowing the yarn to be shipped directly without rewinding. In addition, there remains a need for a lubricant for use in the above process which provides excellent frictional values and lubricity numbers to the yarn and, in addition, also allows the yarn to pass automotive manufacturer's fogging tests.

SUMMARY OF THE INVENTION

The present invention is directed to a process for applying a lubricant to a plurality of yarn packages directly to a dye bath in a package dyeing machine during the dyeing process. The process includes first placing the plurality of yarn packages into a package dyeing machine.

In the case of dye spring packages, the packages are placed on the perforated spindle of the dye carrier or dye stand and then pressed to a compression of between about 10 to 50%. Compressing several yarn packages on one spindle forms a more uniform column density from the individual springs and, in addition, allows an increased number of packages to be dyed in one dye batch.

The plurality of yarn packages are then dyed in the package dyeing machine and the dye bath is cooled. A lubricant is then directly applied to the dye bath and the plurality of yarn packages in the package dyeing machine.

In the preferred embodiment, the lubricant is a wax emulsion based on paraffin wax with a melting point of between about 138° F. to 143° F. However, depending on the amount of lubricity required, the type of wax, and other lubricant additives used, the melting point of the wax could vary. Also in the preferred embodiment, the lubricant contains 38.6% by weight lubricant solids of which 6.1% are emulsifier solids. The emulsifier is a fatty acid amine condensate made by reacting a primary and tertiary amine with a fatty acid.

In an alternative embodiment, the dye bath is drained at the peak dyeing temperature. In addition, the high temperature draining may be done under pressure of between 30 and 50 psi to shorten the cycle time. When the dye bath is drained at high temperature, the dye kier is then refilled with water at the desired application temperature for the in-bath lubricant.

Accordingly, one aspect of the present invention is to provide a method for applying a lubricant to a plurality of yarn packages directly in a dye bath in a package dyeing machine during the dyeing process. The method includes the steps of: (a) placing the plurality of yarn packages into a package dyeing machine; (b) dyeing the plurality of yarn packages in the package dyeing machine; and (c) applying a lubricant to the plurality of yarn packages in the package dyeing machine; and (d) removing the plurality of yarn packages from the package dyeing machine. After applying the lubricant to the yarn packages in the package dye machine, the carrier of yarn is then transferred to a yarn drying machine for drying.

Another aspect of the present invention is to provide a lubricant for adding to a plurality of yarn packages directly in a dye bath in a package dyeing machine during the dyeing process. The lubricant is a wax emulsion based on paraffin wax with a melting point of between about 138° F. to 143° F.

Still another aspect of the present invention is to provide a method for applying a lubricant to a plurality of yarn packages directly in a dye bath in a package dyeing machine during the dyeing process. The method includes the steps of: (a) placing the plurality of yarn packages into a package dyeing machine; (b) dyeing the plurality of yarn packages in the package dyeing machine; (c) cooling the dye bath prior to applying the lubricant to the plurality of yarn packages in the package dyeing machine; (d) applying a lubricant to the plurality of yarn packages in the package dyeing machine, wherein the lubricant is a wax emulsion based on paraffin wax with a melting point of between about 138° F. to 143° F.; and (e) removing the plurality of yarn packages from the package dyeing machine.

These and other aspects of the present invention will become apparent to those skilled in the art after a reading of the following description of the preferred embodiment.

DESCRIPTION OF THE PREFERRED EMBODIMENTS

The process according to the present invention for adding the lubricant during the dye process includes the following steps. First, the package dyeing machine is loaded with the yarn packages and filled with the prime chemicals. The dyes are then added to the package dyeing machine. The temperature in the package machine is raised to 96° C. at 8° C./minute. The temperature is then increased to 110° C. at 4° C./minute. Finally, the temperature is increased to 133° C. at 4° C./minute. This temperature is held for between about 10 to 60 minutes and then the temperature in the dye bath is reduced to 85° C. at 10° C./minute or the dye bath is hot drained at 133° C. and refilled with water at the desired lubricant application temperature. At this point after scour chemicals are added. The bath is further cooled to room temperature and the lubricant is added. The lubricant is introduced into the package dyeing machine at a ratio of between about 6 to 11-1. The packages of yarn are then removed from the package machine, dried and shipped.

In the preferred embodiment, the lubricant is a wax emulsion based on paraffin wax with a melting point of between about 138° F. to 143° F. Also in the preferred embodiment, the lubricant contains 38.6% by weight lubricant solids of which 6.1% are emulsifier solids. The emulsifier is a fatty acid amine condensate made by reacting a primary and tertiary amine with a fatty acid.

The process according to the present invention will become more apparent upon reviewing the following detailed examples:

EXAMPLES 1-4

Fictional values were calculated on spun and filament yarns comparing the present invention, mineral oil based and wax emulsion lubricants. The yarns were tested using fiber-to-metal frictional values on spun nylon, spun polyester, filament polyester and filament nylon. The results of these tests are shown in Table 1.

TABLE 1

| Lubricant | Filament Polyester 1/150/34 | Spun Polyester 16/2 | Filament Nylon 2/70/34 | Spun Nylon 20/2 |
|---|---|---|---|---|
| Present Invention Ex. 1 | 230 Grams | 180 Grams | — | 190 Grams |
| Conventional Wax Emulsion Ex. 2 | 280 Grams | 250 Grams | — | 230 Grams |
| Isafil 4000A Ex. 3 | 340 Grams | — | — | — |
| Lubrol RB-102 Ex. 4 | — | — | 400 Grams | — |

The wax emulsion is a lubricant composed of paraffin, mineral oil and an amine soap available from Henkle Textile Chemical of Charlotte, N.C. Isafil 4000A is a mineral oil lubricant with emulsifier, antistat and non-sling additive made by Boebme-Filatex Inc. of Reidsville, N.C. Lubrol RB-102 is a mixture of fiber lubricants and emulsifiers made by the George A. Goulston Company of Monroe, N.C. As can be see, the present invention had the lowest frictional values of any of the lubricants.

As discussed above, in addition to frictional values and lubricity numbers of the yarn, the yarn and any knitted or woven fabric therefrom also needed to pass an automotive manufacturers fogging test. This test is a measurement of volatile chemicals emitted by interior components of an automobile. The fog test determines the tendency of interior trim materials to produce a light scattering film on a glass surface in a controlled environment.

One well-known test is Ford Laboratory Method BO-114-03. According to this test, a glass plate is first cleaned and its specular reflectance is measured using a gloss meter. A test piece of the material to be tested is placed on the bottom of a beaker. The beaker is placed in a temperature controlled heating unit. The clean glass plate is placed upon the beaker with a silicone rubber seal so that any volatile materials that migrate from the test piece with condense upon the glass plate's undersurface. A coolant system is placed upon the glass plate to control the condensate temperature. After a specified time, the glass plate is removed and specular reflectance are measured again with the same gloss meter.

Reflectance of the fogged plate is expressed as a percentage of the reflectance of a clean plate and is reported as the fogging number. The higher the fogging number, up to a value of 100 (%), means that the gloss of the plate is more nearly identical to its original starting value. A lower fogging number, i.e. less than 100, indicates that volatiles have condensed on the glass plate to produce a light, scattering film. This fog number can be used as a comparative ranking between materials.

A suitable test chamber may be purchased from Haske Buchler Instruments, Inc., of Saddle Brook, N.J. A suitable gloss meter may be obtained from Pacific Scientific of Silver Springs, Md.

EXAMPLES 5-16

Samples of yarn lubricated according to the present invention were tested according to the Ford Laboratory Test Method BO 116-03. The following values are shown in Table 2.

TABLE 2

| Example No. | Fogging No. (%) | Lab Performing Test | Comments |
|---|---|---|---|
| 5 | 72-81 | Chatham | Dry fog, but with crystals. |
| 6 | 84-93 | Joan Fabrics | Dry fog. |
| 7 | 81-93 | Dupont | — |
| 8 | 76-85 | Dupont | Fog residue was clear, dry and uniform. |
| 9 | 83.7 avg. | Milliken | No clear film on any of the plates. |
| 10 | 84-93 | Joan Fabrics | Dry fog. |
| 11 | 75-84 | Guilford Mills | — |
| 12 | 80-98 | Guilford Mills | — |
| 13 | 82.6 | Dupont | Clear. |
| 14 | 66.5 | Joan Fabrics | Dry Fog. |
| 15 | 97.5 | Dupont | Clear. |
| 16 | 79.0 | Joan Fabrics | Dry Fog. |

A fogging number of 60 without oily droplets has been determined by Ford to be a minimum acceptable standard. As can be seen the present invention using the preferred lubricant of the present invention met this test with values between about 67 to 99. This compares favorably with hydroset polyester (through a dye cycle using water only) which was used as a control and had test values between about 80 to 98.

In an alternative embodiment, a satisfactory lubricant can also be added to yarn in a conventional kiss roll method by decreasing the lubricant solids to about 11.6% of which 1.8% are emulsifier solids. Again, the emulsifier is a fatty acid amine condensate. This is formed by a reaction between a primary and tertiary amine in a fatty acid. The frictional values and fog number obtained are comparable to those obtained according to the process of the present invention in which the dyeing and lubricant are added together.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A method for applying a lubricant to a plurality of yarn packages directly in a dye bath in a package dyeing machine, said method including the steps of:

(a) placing said plurality of yarn packages into a package dyeing machine;

(a1) heating said dye bath to a temperature sufficient for dye fixation;

(b) dyeing said plurality of yarn packages in said package dyeing machine;

(c) cooling the dye bath to about room temperature prior to applying said lubricant to said plurality of yarn packages in said package dyeing machine;

(d) applying said lubricant to said plurality of yarn packages in said package dyeing machine, wherein said lubricant is a wax emulsion based on paraffin wax with a melting point of between about 138° F. to 143° F.; and (e) removing said plurality of yarn packages from said package dyeing machine.

2. The method according to claim 1, wherein step (b) includes adding dye stuff to the dye bath, heating the dye bath to fix the dyes, and rinsing said yarn packages in said package dyeing machine.

3. The method according to claim 1, wherein said lubricant is a fatty acid amine condensate.

4. The method according to claim 1, wherein said lubricant includes about 40 wt. % lubricant solids.

5. The method according to claim 4, wherein said lubricant solids includes about 6 wt. % emulsifier solids.

6. The dyed and lubricated yarn produced according to claim 1.

* * * * *

Disclaimer 5,387,263—Jack W. Marlowe, Reidsville; Ralph B. Monk, Roxboro; Rene A. Eckert, Greensboro, all of N.C. METHOD FOR TREATMENT OF YARN IN PACKAGE FORM. Patent dated Feb. 7, 1995. Disclaimer filed Jan. 29, 1998, by the assignee, Unifi.

Hereby enters this disclaimer to claims 1-6 of said patent.

*(Official Gazette,* September 8, 1998)